United States Patent [19]

Kim

[11] Patent Number: 4,745,757

[45] Date of Patent: May 24, 1988

[54] COMBINED HEAT RECOVERY AND MAKE-UP WATER HEATING SYSTEM

[75] Inventor: Soo Y. Kim, West Hartford, Conn.

[73] Assignee: Energy Services Inc., Farmington, Conn.

[21] Appl. No.: 17,938

[22] Filed: Feb. 24, 1987

[51] Int. Cl.[4] ..... F22D 1/50

[52] U.S. Cl. ..... 60/667; 60/39.182; 60/664

[58] Field of Search ..... 60/646, 657, 660, 664, 60/665, 667, 670, 39.182

[56] References Cited

U.S. PATENT DOCUMENTS

| | | | |
|---|---|---|---|
| 2,623,506 | 12/1952 | Dalin et al. | 122/412 |
| 3,175,367 | 3/1965 | Gorzegno et al. | 60/646 |
| 4,311,013 | 1/1982 | Kuribayashi et al. | 60/646 |
| 4,318,366 | 3/1982 | Tompkins | 122/20 B |
| 4,402,183 | 9/1983 | Dimitroff et al. | 60/660 |

*Primary Examiner*—Stephen F. Husar

*Attorney, Agent, or Firm*—Chilton, Alix & Van Kirk

[57] ABSTRACT

A cogeneration plant is disclosed in which the feedwater from the deaerator heater is placed in heat exchange relation with the makeup water before the makeup water is delivered to the deaerator heater. The amount of heat transferred from the feedwater to the makeup water is controlled in response to the stack gas temperature. The feedwater from the heat exchanger is then placed in heat exchange relation with the stack gas, either in the economizer or through a separate coil, to take advantage of waste heat that would otherwise be lost.

20 Claims, 4 Drawing Sheets

COMBINED HEAT RECOVERY AND MAKE-UP WATER HEATING SYSTEM

BACKGROUND AND SUMMARY OF THE INVENTION

The present invention relates generally to steam generating systems for producing process steam and/or steam for operating a steam turbine, and more particularly to a new and improved method and apparatus for the recovery of additional heat from the stack gas of the steam generating system.

The heat recovery system has notable application in cogeneration plants of the type conventionally employing a gas turbine for generating electricity, coupled to a heat recovery steam boiler system for generating steam from the high temperature exhaust gas. In such a plant, it is desirable to regulate the boiler system exhaust gas temperature within a preestablished desired temperature range to minimize exhaust gas heat loss while maintaining the exhaust gas above a temperature at which undesirable condensation occurs. This type of plant is described for example in U.S. Pat. No. 4,572,110, "Combined Heat Recovery and Emission Control System", issued Feb. 25, 1986.

It is a principal object of the present invention to provide in a steam generating system a new and improved method and apparatus for recovering heat from the exhaust gas in such a way as to increase the overall efficiency of the plant without undesirable condensation within the exhaust gas.

It is another object of the present invention to provide in a cogeneration plant of the type described a new and improved method and apparatus for regulating the stack temperature within a preestablished desired temperature range for efficient operation of the cogenerating plant.

It is a further object of the present invention to provide in a steam generating system a new and improved method and apparatus for employing an economizer of the system for controlling the stack temperature while minimizing or preventing internal and external corrosion of the economizer tubes and minimizing or preventing undesirable feed water steaming within the economizer.

These and other objects are accomplished with the present invention, by providing a new and improved method and apparatus for preheating the system makeup water through a heat exchange with the system feedwater, and thereby decreasing the auxiliary steam requirement for the feedwater deaerator while increasing the exhaust gas heat transfer to the feedwater in the economizer.

In accordance with the present invention, a cogeneration plant is provided with a combined heat recovery and makeup water heating system in which the feedwater from the deaerator heater is placed in heat exchange relation with the makeup water, thereby increasing the temperature of the makeup water delivered to the deaerator and decreasing the temperature of the feedwater delivered to the economizer or similar coil in the stack. In this arrangement, the makeup water is deaerated and, after mixing with the feedwater in the deaerated heater, is delivered to the economizer in a condition that will not cause internal corrosion of the economizer tubes.

With the makeup water heated to a temperature approaching that of the feedwater, the fluid entering the deaerator heater is at a higher average temperature and thus requires less auxiliary steam from the steam generator in order to sustain the design operating conditions. The net effect is an increase in plant efficiency by indirectly transferring the low temperature stack gas heat to the make-up water. Therefore, the steam savings associated with heating the deaerator can be delivered to the load.

In the preferred embodiment, the invention further includes a controller responsive to the temperature of the exhaust gases in the stack downstream of the evaporator for adjusting the amount of heat transferred from the feedwater to the makeup water. This adjustment is intended primarily to avoid the stack gas temperature from dropping below the condensation point of materials in the gas stream that can corrode the exterior of the economizer tubes, e.g. sulfuric acid. Preferably, the controller operates a three-way valve through which makeup water is delivered to the heat exchanger or bypassed around the heat exchanger in proportions that are determined by the control algorithm.

The present invention thus improves the steam generating efficiency of the plant, while avoiding both internal and external corrosion of the economizer. The advantages of the present invention in terms of steam plant performance improvement, are substantially proportional to the ratio of makeup water flow to feedwater flow. Thus, the invention is of particularly noteworthy advantage when used in conjunction with a cogeneration plant having steam injection to a gas turbine in the primary cycle.

BRIEF DESCRIPTION OF THE DRAWINGS

These and other objects and advantages of the invention will be more fully understood from the following detailed description of the preferred embodiment and the accompanying drawings, in which.

DESCRIPTION OF THE PREFERRED EMBODIMENTS

Figure 1:
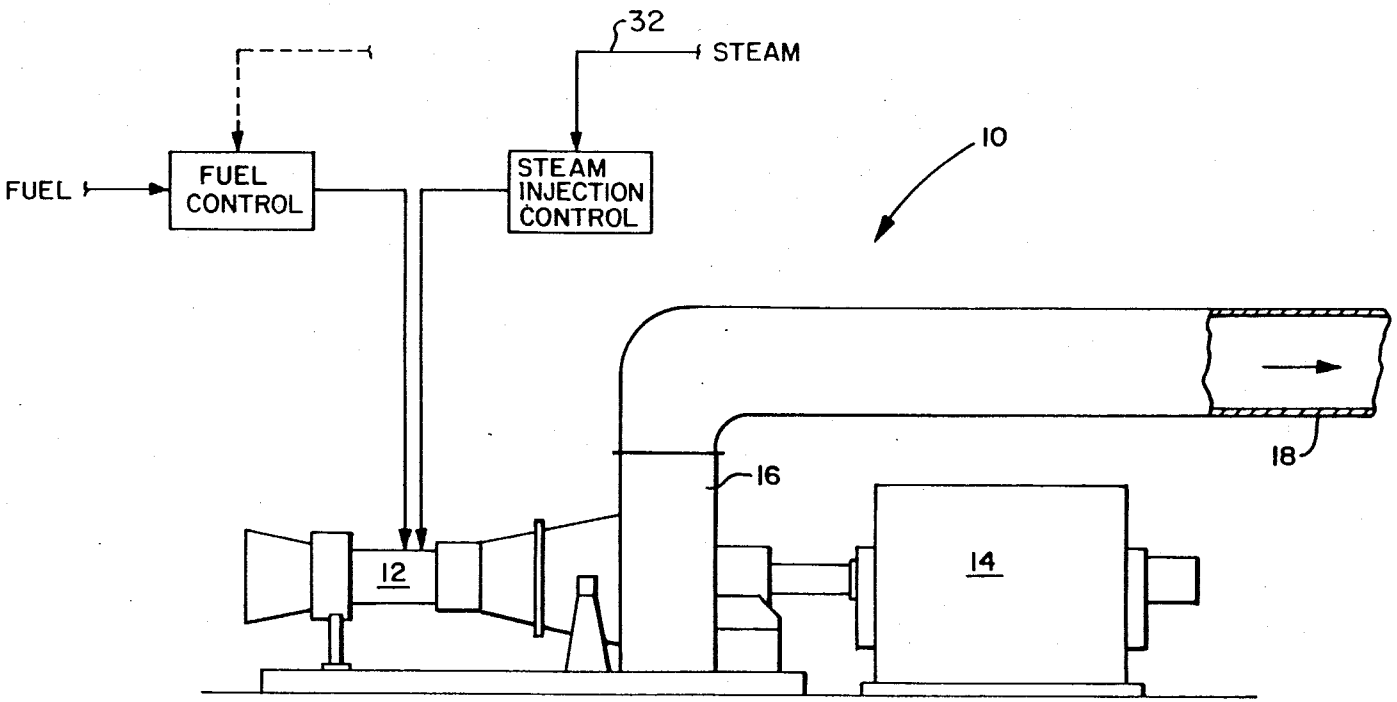
FIG. 1 is a schematic view of the gas turbine stage of a cogeneration plant.

The preferred embodiment of the invention will be described with reference to the drawings, wherein like numerals represent the same or like parts. A first stage 10 of cogeneration plant employing an embodiment of the present invention is shown in FIG. 1, comprising a gas turbine internal combustion engine 12 connected for driving an electric generator 14 for generating electric power in a conventional manner. In order to provide maximum electric power generating efficiency (i.e., minimum specific fuel consumption), the gas turbine engine 12 is preferably continuously operated at its rated load, thereby producing an exhaust gas stream having a predetermined temperature, velocity and mass rate of flow at the gas turbine outlet 16. Typically, the exhaust gas temperature at the gas turbine outlet 16 at rated engine load ranges from between 775 degrees F.

and 1050 degrees F. depending on the gas turbine engine employed and the rate of fuel and water or steam injection into the engine combustion chamber.

Figure 2:
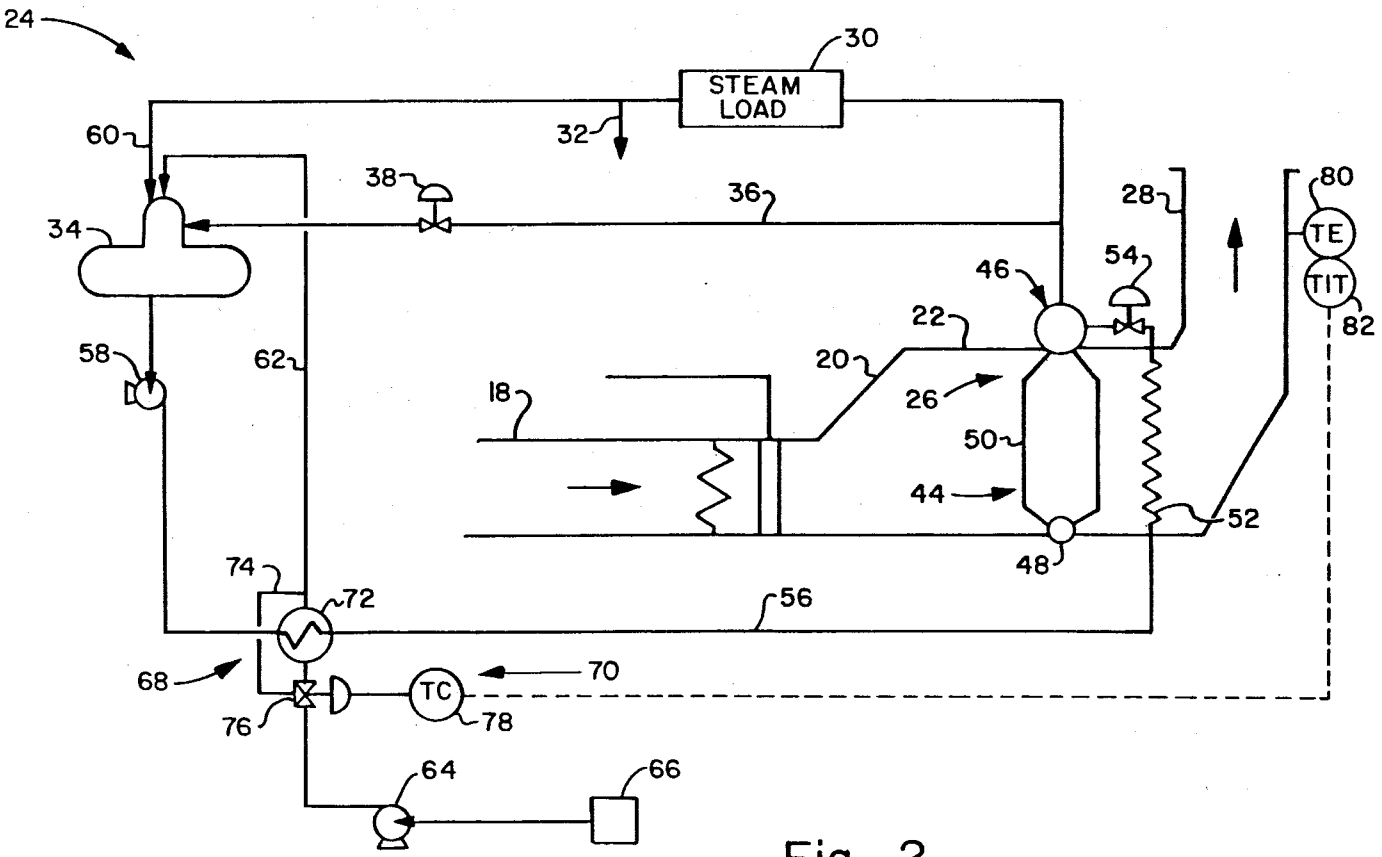
FIG. 2 is a diagrammatic view of the heat recovery steam boiler system in accordance with the present invention as adapted for coupling as a second stage to the gas turbine system of FIG. 1.

As shown in FIGS. 1 and 2, an engine outlet duct 18 connects the engine outlet 16 via a diverging duct 20 to an elongated duct 22 having a large, generally constant cross-sectional area. The latter duct 22 provides for conducting the exhaust stream into a second stage 24 which includes a steam generating system 26. A vertical stack 28 finally exhausts the gas stream to atmosphere.

The steam generating system 26 of the cogeneration plant supplies steam to a steam load 30 and suffers a certain steam loss 32 (the steam load and steam loss being diagrammatically in the FIG. 2). The remaining steam condensate is returned to a deaerator heater 34. In a conventional manner, the process steam may be used in a manufacturing facility and/or auxiliary steam generator.

Deaerator heating steam is supplied by the steam generating system 26 via a conduit 36 and a pressure control valve 38 to the deaerator heater 34.

The steam generator system 26 is shown for simplicity as comprising a single steam boiler heat exchanger 44 having an upper main steam drum 46, a bottom mud drum 48 and a bank 50 of heat transfer evaporator, or steam generating, tubes connected between the steam and mud drums. For example, the bank 50 of steam generating tubes comprises 10–20 rows of tubes with 10–20 tubes in each row. The gas stream duct 22 conducts the hot gas stream through the bank 50 of steam generating tubes to generate steam within the steam boiler for supplying process steam and deaerator heating steam as described.

The single stage steam boiler 44 is controlled to maintain steam pressure of for example 400 p.s.i.a. in the steam drum 46 and process steam is supplied to the steam load 30 at that pressure. The pressure control valve 38 in the auxiliary steam supply conduit 36 to the deaerator heater is suitably regulated to maintain a pressure of for example 30 p.s.i.a. in the deaerator heater 34.

Commonly, one or more economizer tube banks 52 are located downstream of the evaporator 50 to extract energy remaining in the gas before it exits the plant through stack 28. In the economizer, the feedwater is preheated to the stack gas temperature before being returned to the steam drum 46 through the level control valve 54. The feedwater supply line 56 to the economizer 52 is connected to the deaerator heater 34 and is typically under forced circulation by means of the boiler feedwater pump 58 located intermediate the deaerator heater 34 and the economizer 52.

In the deaeration process accomplished in the deaerator heater 34, dissolved oxygen in the boiler feedwater returning from the condensate line 60 and make-up water supplied from the make-up water line 62 can be released by direct contacting of low pressure auxiliary steam from line 36. This deaeration processing heats the boiler feedwater to the saturation temperature of the deaerator's operating pressure, permitting release of the dissolved gases. For typical deaerator pressure of 30 p.s.i.a., the saturation temperature is 250 degrees F.

A makeup water supply line 62 is typically connected to the deaerator heater 34 so that makeup water can be supplied via makeup pump 64 from a makeup water tank 66. The makeup water in the tank 66 is typically at atmospheric pressure and ambient temperature, e.g., 50 degrees F. The quantity of makeup water introduced into the system 24 compensates for the losses 32. In a cogeneration plant of the type described herein, the major component of such losses is the diversion of some of the process steam back into the first stage 10, for injection into the turbine 12.

The introduction of makeup water into the steam system 26 decreases the performance or efficiency of the system, due primarily to the low temperature of the makeup water. Thus, considerable quantities of steam may be required for typical deaerator operation and the diversion of this steam to line 36 naturally reduces the amount of steam available for the steam load 30. The deaerator heating steam can be drawn from equipment associated with the steam load 30 rather than upstream of the load as shown in FIG. 2. It should be understood that regardless of where in the system 26 the deaerating heating steam is drawn, such steam is directly or indirectly fluidly connected to the steam drum 46 and thus represents a significant fraction of the steam generated therein, which is not available for useful work for the steam load.

In accordance with the present invention, a heat exchanger arrangement 68 is provided downstream of the deaerator 34 to exchange heat between the feedwater in line 56 and the makeup water in line 62, thereby increasing the temperature of the makeup water delivered to the deaerator 34 and decreasing the temperature of the feedwater delivered to the economizer 52, without exchange of fluids. In this manner, the makeup water supplied through line 62 to the deaerator can be heated to about 240 degrees F., thus reducing the amount of deaerator heating steam required to be supplied to the deaerator heater 34.

In a conventional system having a makeup flow equal to 15 per cent of feedwater flow, the feedwater in line 56 is at about 250 degrees F. and the gas temperature immediately downstream of the evaporator is about 465 degrees F. The heating of the feedwater in the economizer 52 raises the feedwater temperature at the inlet to the valve 54 to a temperature of about 445 degrees. The temperature of the stack gas downstream of the economizer is thus reduced to about 364 degrees F.

With the present invention installed in such a conventional system, the inlet temperature of the feedwater to the economizer 52 can be reduced to about 216 degrees F., which enables the economizer to extract more energy from the gases downstream of the evaporator 50. The feedwater can still be raised to about 445 degrees F. at the inlet to the valve 54, while the stack gas temperature is reduced to about 347 degrees F. The net effect of the heat exchanger arrangement 68 is to provide feedwater at valve 54 at essentially the same temperature as available in conventional systems so that the same amount of steam can be generated in the steam drum 46, but the diversion of steam through line 36 or equivalent lines has been considerably reduced due to the higher temperature of the makeup water entering the deaerator 34 through line 62.

Figure 3:
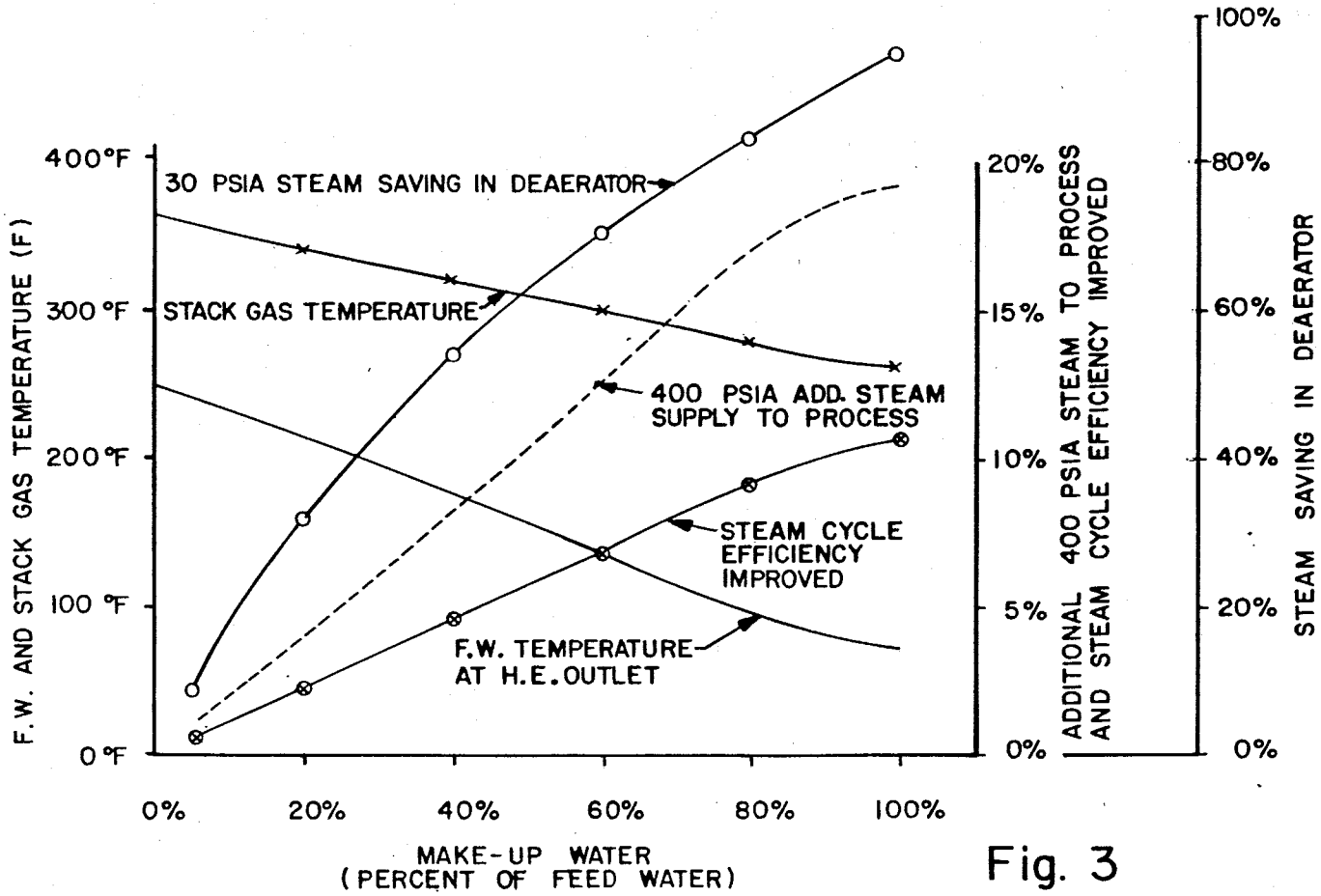
FIG. 3 is a graphic representation of the performance improvement of the steam generating system in accordance with the present invention, as a function of the ratio of makeup water to feedwater.

FIG. 3 graphically represents the effect on various system operating parameters, of subjecting all of the makeup water to the heat exchange relationship with the feedwater. In the model system, the steam output is at 400 p.s.i.a. saturated and the deaerator operates at 250 degrees F. and 30 p.s.i.a. The makeup water is at 50 degrees F. and the hot gas enters duct 20 from the gas turbine at the rate of 950,000 lbs. per hour at 950 degrees F. with no firing of any duct burners. It may be seen that the greater the requirement for makeup water in a given system, the greater the potential improvement in efficiency available by utilizing the present invention. It should be understood that at the theoretical limit where no makeup water is required for the system, the savings associated with the present invention approach zero, i.e., none of the steam diverted through line 36 is needed to heat any makeup water, since no makeup water is delivered to the deaerator 34. However, in any practical system, a makeup water supply is necessary, and in the typical system with the $NO_x$ control steam injection to the gas turbine, the makeup water represents about 15 per cent of the feedwater flow rate. For mass steam injection associated with electric power augmentation, the makeup water flow into the gas turbine is about 60–80% of the feedwater flow.

In accordance with the preferred embodiment of the invention, the heat exchanger arrangement 68 is coupled to a control system 70 that is responsive to the temperature of the gas in the stack 28 downstream of the economizer 52, for controlling the amount of heat transferred from the feedwater in line 56 to the makeup water in line 62. Although running the plant at maximum efficiency would require maintaining all of the makeup water delivered by pump 64 in heat exchange relation with all of the feedwater delivered by pump 58, an additional constraint arising from the corrosion characteristics of the economizer tubes should be taken into account. Thus, the control system 70 is arranged to operate so as to maintain a stack gas temperature above the dew point temperature associated with corrosive chemicals in the gas stream. The control system 70 thus has associated with it a temperature set point such that the amount of heat transferred to the makeup water through the heat exchanger arrangement 68 is decreased when the stack temperature drops below the set point corresponding to the dew point temperature of a preselected corrosive chemical contained in the gas. As a practical matter, the low temperature limit would be about 240 degrees F. The actual value can be determined by practitioners in this art, based on the sulfur content and burning properties of the fuel.

An upper limit set point on the stack gas temperature is not necessary, since the desirable operating condition is for the maximum transfer of heat from the feedwater to the makeup water, so long as the stack temperature is above the minimum set point. This is consistent with the desire to maintain the minimum flue gas temperature without dropping below the set point.

One heat exchanger arrangement 68 that can easily accomplish such control function is a conventional shell and tube feedwater heat exchanger 72 connected and parallel with a bypass line 74 in the makeup line 62. A three-way flow control valve 76 has an inlet for receiving the makeup water from the pump 64 and two outlets, one for delivering makeup water to the heat exchanger 72 and the other for bypassing the heat exchanger through line 74. Thus, the fraction of the makeup water flow that enters the heat exchanger can be controlled.

The valve 76 is connected to the control system 70, which preferably includes a valve controller 78. The controller 78 receives a signal generated by a thermal electric sensing element 80 and a temperature transmitter 82. The sensing element 80 is mounted in the stack 28 downstream of the economizer 52, and through the transmitter 82 delivers a signal to the controller 78 that is commensurate with the stack as temperature. The controller can be of a conventional, microprocessor type which is easily programmable by those skilled in this art, for controlling the valve 76 in response to the stack gas temperature. Depending on the desired control band on the feedwater temperature to be delivered to the economizer 52, the valve 76 may be operated in a binary mode, i.e., all of the flow from makeup pump 64 is selectively delivered either through the heat exchanger 72 or the bypass line 74, or in a finer mode, in which the fraction or division of the flow from the makeup pump 64 to the heat exchanger 72, can be gradually adjusted from zero to 100%.

A typical situation in which the feedwater heat exchanger arrangement 68 would require control action, is during gas turbine startup. The boiler 44 and economizer 52 are relatively cold. The temperature signal delivered to the controller 78 will open the bypass 74 around the heat exchanger 72, thereby supplying hot boiler feedwater at, for example, 250 degrees F. to the boiler economizer and thus maintaining the desired stack gas temperature above the gas condensation temperature. (It has been assumed in this example that sufficient steam is available in the steam drum 46 or elsewhere to operate the deaerator 34 at design conditions.) As the gas turbine load increases, the gas temperature in duct 22 increases, and the gas temperature in stack 28 decreases. The control system 70 will modulate the quantity of makeup water bypassing the feedwater heat exchanger 72 based on the temperature of the feedwater flowing through the economizer 52 which satisfies the set point of the control system 70, e.g., the temperature transmitter 82. Operation of the stack gas control loop 70 will result in heating of the makeup water entering the deaerator 34, cooling of the feedwater entering the economizer 52 and cooling of the gas in the stack 28. However, the stack gas temperature will be maintained above the dew point for the particular concentration of sulfuric and/or sulfurous acid in the stack gas at the time of operation.

Normally, the temperature control valve 76 will control over the full range of make-up water flows and make-up water temperatures to maintain the stack gas temperature within the set point of the temperature indicating transmitter 82. The deaeration steam will be controlled by the pressure control valve 38 in the line 36. When the stack gas temperature is above the set point, the temperature control valve 76 will close the feedwater heat exchanger bypass lines 74 and supply all makeup water to the deaerator to the feedwater heat exchanger 72.

It should be appreciated that the system 26 represented in FIG. 2 is somewhat of a simplification and that in practice, the steam generator boilers 44 may be provided in multiples within the the duct 22, and include superheaters (not shown). Also, a plurality of economizers 52 may be provided downstream of the steam boiler 44. In such arrangements, the feedwater heat exchanger arrangement 68 would preferably be located so that the feedwater line 56 from the heat exchanger 72 would be connected to the inlet of the last economizer in the duct 22, although this is not absolutely necessary. Furthermore, a second economizer (not shown) could be located between the economizer 52 that is connected to the heat exchanger 72 via line 56, and the control valve 54 associated with the steam drum 46, so long as the economizer 52 used in conjunction with the invention is fluidly connected to the steam drum 46. Finally, it should be understood that particularly in systems with superheaters, the deaerator heating steam can be taken from a steam turbine or the like rather than directly from the steam drum 46, and the benefits associated with the invention will still be realized.

The selection of a location for a feedwater heat exchanger 72 is based on the boiler design pressure and deaerator operating pressure as well as the quantity and temperature of the makeup water which vary depending on the process steam load and electric generating requirement of the plant.

Those skilled in this art will also appreciate that the present invention improves the efficiency of the plant without subjecting the economizer tubes to problems of internal and external corrosion. Although the makeup water in tank 66 contains oxygen and is thus potentially corrosive in the heated environment within the economizer tubes, the makeup water is first deaerated in the deaerator to remove the oxygen and thus when passing through the economizer 52, it is indistinguishable from deaerated feedwater for which the economizer is normally designed.

Another advantage is that the temperature of the feedwater in the economizer 52 can be controlled. The difference in temperature between feedwater and the steam drum 46 can thus be maintained at a predetermined value, thereby reducing the possibility that steaming may occur in the economizer 52 under boiler off-design conditions.

The present invention can be retrofitted on existing steam generating systems 26 which have high stack gas temperature, in order to recover the waste heat and produce useful energy. In retrofitting this system on an existing plant, additional economizer surface will be required to maintain the same feedwater condition at the level control valve. Application of the present invention is particularly beneficial for cogeneration plants designed for mass steam injection into the gas turbine resulting in electric power augmentation, because of the relatively large quantities of makeup water required.

Figure 4:
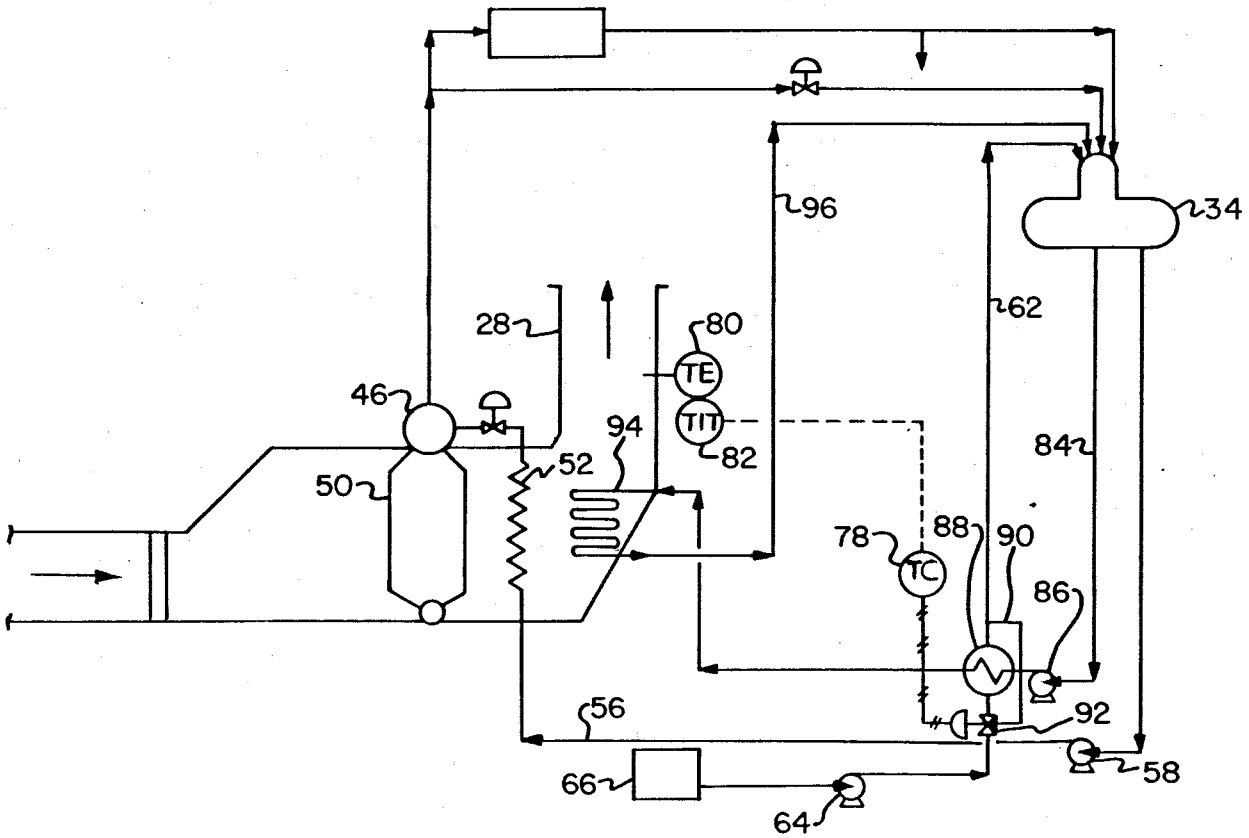
FIG. 4 is a diagrammatic view of an alternative embodiment of the invention.

FIG. 4 illustrates an alternative embodiment of the invention, in which a separate, low-pressure line is used to heat up the make-up water before it is introduced into the deaerator heater. Like numerals in FIG. 4 refer to like components identified and described with respect to FIG. 2.

A low pressure line 84 delivers a portion of the total feedwater discharged from the deaerator heater 34, to a low pressure pump 86 that supplies hot water at less than 100 psi to the tube side of the make-up water heat exchanger 88. In this embodiment, the balance of the feedwater is delivered at the higher pressure (400–500 psi), by boiler feedwater pump 58, into the economizer 52 for delivery to the steam drum 46. The portion of the total feedwater in line 84 is placed in heat exchange relation with the make-up water from the make-up water supply tank 66, whereby the makeup water temperature is raised from approximately 50 degrees F. to approximately 240 degrees F. A bypass line 90 can be opened by valve 92, which is in turn controlled as in the previous embodiment in response to the temperature signals from the instrumented controllers 80, 82 and 78.

The heat that is extracted from the portion of the feedwater delivered through the make-up water heat exchanger 88, is recovered by passing the water through heat exchanger coil 94 in the duct 28, where the stack gas heats the water to a temperature substantially equal to the operating temperature of the deaerator heater 34. The coil return line 96 delivers the heated water back to the deaerator heater 34. The water in line 84 is not fluidly exchanged with the make up water in line 62, and thus maintains its deaerated condition while in the coil 94 and as returned to the deaerator heater 34. Thus, although coil 94 is located in the stack, the potential problem of internal corrosion is obviated because the water in the tubes does not contain corrosive oxygen. The potential problem of external corrosion is obviated by controlling the stack gas temperature through operation of the temperature responsive valve 92 as in the previously described embodiment.

With the embodiment of the invention described in FIG. 4, the heat exchanger 88 can be obtained for a significantly lower cost than the heat exchanger 72 associated with the embodiment of FIG. 2. The pump 86 need only deliver fluid at 80–85 p.s.i., rather than at the higher pressure, exceeding 400 psi, normally required for the boiler feedwater pump 58 of the embodiment of FIG. 2. Also, the embodiment of FIG. 4 is in most instances easier to retrofit into existing plants than the embodiment illustrated in FIG. 2. Another advantage of the embodiment of FIG. 4 is that the makeup water heat exchange subsystem 86,88,94 can be shut down or isolated without significant effect on the main flow of feedwater to the economizer. It is thus believed that in most instances, the combined costs of adding the makeup water line 84, low pressure pump 86, low pressure heat exchanger 88 and coil 94 would be lower than the cost associated with installing the high pressure heat exchanger 72 in the embodiment of FIG. 2.

As broadly viewed, the invention thus includes coupling a makeup water heat exchanger 72, 88, with heat exchanger means 52, 94 downstream of the evaporator 50 for heating makeup water delivered to the deaerator heater 34, and for decreasing the temperature of the stack gas. Even though the makeup water is intermixed with the feedwater and is subjected to the high temperatures of the stack gas, the potential problems associated with internal and external corrosion of tubes in the stack gas are eliminated.

What is claimed is:

1. A cogeneration plant comprising in combination:

a first stage source of hot gas;

a duct having an inlet for receiving the hot gas and an outlet stack open to the atmosphere;

a second stage recovery heat steam generator including an evaporator situated in the duct, an economizer in the duct downstream of the evaporator, and steam drum fluidly connected to the evaporator and the economizer;

feedwater supply means including a deaerator heater and feedwater pump for supplying deaerated feedwater to the steam drum through said economizer;

makeup water supply means including a makeup pump for delivering makeup water to the deaerator heater;

means fluidly connected to the steam drum for supplying auxiliary steam to the deaerator heater; and heat exchanger means located between the deaerator and the economizer, for transferring heat from the feedwater to the makeup water, thereby increasing the temperature of the makeup water delivered to the deaerator and decreasing the temperature of the feedwater delivered to the economizer, without fluid exchange.

2. The cogeneration plant of claim 1, further including means responsive to the temperature of the gas in the stack downstream of the economizer, for controlling the amount of heat transferred from the feedwater to the makeup water.

3. The cogeneration plant of claim 2 wherein said means for controlling the amount of heat transferred from the feedwater to the makeup water operate to decrease the amount of heat transferred to the makeup water when the stack temperature drops below a set point corresponding to the dew point temperature of a preselected corrosive material in the gas.

4. The cogeneration plant of claim 2 wherein said means for controlling the amount of heat transferred from the feedwater to the makeup water includes bypass means for controlling the fraction of the makeup water flow that enters the heat exchanger means.

5. The cogeneration plant of claim 2 wherein the means for controlling the amount of heat transferred from the feedwater to the makeup water include, a thermal sensing element mounted in the stack downstream of the economizer, a temperature transmitter associated with the thermal sensing element for generating a signal indicative of the stack temperature, a flow control valve having an inlet for receiving makeup water from the makeup water pump and two outlets for dividing the makeup between an inlet line to the heat exchanger means and a bypass line around the heat exhanger means, and a valve controller responsive to the temperature indicating signal for controlling the fraction of the makeup water that enters the heat exchanger over the range of zero to 100%.

6. The cogeneration plant of claim 3 wherein the set point is about 240 degrees F.

7. The cogeneration plant of claim 1, further including means fluidly connecting the steam drum to the gas turbine for injecting steam into the turbine, and wherein the flow of makeup water through the makeup pump is substantially equal to the flow of steam injected into the gas turbine plus steam system losses.

8. The cogeneration plant of claim 1, wherein the makeup water flow rate is at least about 5% of the feedwater flow rate.

9. In a steam generating system including a steam generator with an economizer located in the flow path of a hot gas, the system including a load, a condensate return line from the load to a deaerator heater, a pump for delivering feedwater from the deaerator to the economizer, means for supplying feedwater from the economizer to the steam generator, and a supply of makeup water at ambient temperature and pressure, a method for controlling the temperature of the gas downstream of the economizer comprising the steps of:

determining the temperature of the gas downstream of the economizer;

deliverying makeup water from said supply of makeup water to the deaerator heater; and transferring heat from the feedwater to the makeup water downstream of the deaerator heater, at a transfer rate dependent on the determined gas temperature.

10. The method of claim 9 wherein the step of transferring heat includes the steps of passing at least some of the feedwater and at least some of the makeup water through a heat exchanger without exchange of fluid, and controlling the flow rate of at least one of the feedwater and makeup water into the heat exchanger, in response to the determined gas temperature.

11. The method of claim 10 wherein the step of transferring heat further includes the steps of diverting a portion of the feedwater from the deaerator heater through a low pressure heat exchanger to transfer heat to the makeup water, and delivering the balance of the feedwater from the deaerator at high pressure to the economizer.

12. The method of claim 11 further including the step of passing said portion of the feedwater into heat exchange relation with the stack gas downstream of the evaporator after said portion exits the low pressure heat exchanger, and returning said portion to the deaerator heater.

13. A steam generating plant comprising in combination:

a source of hot gas;

a duct having an inlet for receiving the hot gas and an outlet stack open to the atmosphere;

a steam generator including an evaporator situated in the duct and a steam drum fluidly connected to the evaporator;

duct heat exchanger means situated in the duct downstream of the evaporator;

deaerator heater means for supplying deaerated water to the duct heat exchanger means;

means for supplying at least some of the deaerated water from the duct heat exchanger means to the steam drum;

makeup water supply means for delivering makeup water to the deaerator heater;

means fluidly connected to the steam drum for supplying auxiliary steam to the deaerator heater;

makeup water heat exchanger means fluidly connected between the deaerator heater and at least a portion of said duct heat exchanger means, for transferring heat to the makeup water thereby increasing the temperature of the makeup water delivered to the deaerator and decreasing the temperature of the water delivered to said portion of the duct heat exchanger, without fluid exchange.

14. The plant of claim 13 wherein the duct heat exchanger means consists of an economizer fluidly connected between the deaerator heater and the steam drum.

15. The plant of claim 13 wherein the duct heat exchanger means consists of an economizer fluidly connected between the deaerator heater and the steam drum and a coil fluidly connected between the outlet of the makeup water heat exchanger and the inlet of the deaerator heater.

16. The plant of claim 15, further including means responsive to the temperature of the gas in the stack downstream of the economizer, for controlling the amount of heat transferred from the feedwater to the makeup water.

17. The plant of claim 16 wherein said means for controlling the amount of heat transferred from the feedwater to the makeup water operate to decrease the amount of heat transferred to the makeup water when the stack temperature drops below a set point corresponding to the dew point temperature of a preselected corrosive material in the gas.

18. The plant of claim 16 wherein said means for controlling the amount of heat transferred from the feedwater to the makeup water includes bypass means for controlling the fraction of the makeup water flow that enters the makeup water heat exchanger means.

19. The plant of claim 16 wherein the means for controlling the amount of heat transferred from the feedwater to the makeup water include, a thermal sensing element mounted in the stack downstream of the economizer, a temperature transmitter associated with the thermal sensing element for generating a signal indicative of the stack temperature, a flow control valve having an inlet for receiving makeup water from the makeup water supply and two outlets for dividing the makeup water flow between an inlet line to the makeup water heat exchanger means and a bypass line around the makeup water heat exhanger means, and a valve controller responsive to the temperature indicating signal for controlling the fraction of the makeup water that enters the makeup water heat exchanger over the range of zero to 100%.

20. The plant of claim 17 wherein the set point is about 240 degrees F.

* * * * *